US010196879B2

(12) United States Patent
Cain et al.

(10) Patent No.: US 10,196,879 B2
(45) **Date of Patent: *Feb. 5, 2019**

(54) FLOATING STRUCTURE AND RISER SYSTEMS FOR DRILLING AND PRODUCTION

(71) Applicant: Cameron International Corporation, Houston, TX (US)

(72) Inventors: David Cain, Houston, TX (US); William F. Puccio, Houston, TX (US); Shian J. Chou, Houston, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/808,432

(22) Filed: Jul. 24, 2015

(65) Prior Publication Data

US 2015/0330160 A1 Nov. 19, 2015

Related U.S. Application Data

(63) Continuation of application No. 13/785,083, filed on Mar. 5, 2013, now Pat. No. 9,097,098.

(60) Provisional application No. 61/606,822, filed on Mar. 5, 2012.

(51) Int. Cl.

| | |
|---|---|
| ***E21B 17/01*** | (2006.01) |
| ***E21B 7/12*** | (2006.01) |
| ***E21B 41/00*** | (2006.01) |
| ***E21B 19/00*** | (2006.01) |

(52) U.S. Cl.

CPC ..... *E21B 41/0007* (2013.01); *E21B 7/12* (2013.01); *E21B 17/01* (2013.01); *E21B 17/012* (2013.01); *E21B 19/006* (2013.01)

(58) Field of Classification Search

None

See application file for complete search history.

(56) References Cited

U.S. PATENT DOCUMENTS

| | | | | | |
|---|---|---|---|---|---|
| 3,999,617 | A | * | 12/1976 | Ilfrey | E21B 7/128 175/7 |
| 4,351,261 | A | * | 9/1982 | Shanks | B66C 13/02 114/264 |
| 5,676,209 | A | | 10/1997 | Reynolds | |
| 5,875,848 | A | * | 3/1999 | Wolff | E21B 17/01 166/345 |

(Continued)

FOREIGN PATENT DOCUMENTS

| | | |
|---|---|---|
| WO | 03029606 | 4/2003 |

OTHER PUBLICATIONS

International Search Report and Written Opinion of PCT Application PCT/US2013/029101 dated Jun. 26, 2013: pp. 1-10.

*Primary Examiner* — Matthew R Buck
*Assistant Examiner* — Douglas S Wood
(74) *Attorney, Agent, or Firm* — Helene Raybaud

(57) ABSTRACT

An offshore well system for a subsea well, including a floating platform, a drilling riser system connected with the well for drilling operations, and a production riser system connected with the well for production operations. The drilling system also includes a riser tension system. The riser tension system is capable of compensating for movement of the platform while adequately tensioning both drilling riser system and the production riser system when each is connected to the well.

21 Claims, 7 Drawing Sheets

(56) References Cited

U.S. PATENT DOCUMENTS

| | | | | |
|---|---|---|---|---|
| 6,273,193 | B1 * | 8/2001 | Hermann | E21B 7/128 166/350 |
| 6,691,784 | B1 | 2/2004 | Wanvik | |
| 7,008,141 | B2 | 3/2006 | Fitzgerald et al. | |
| 7,588,393 | B1 * | 9/2009 | Shivers | B63B 21/50 166/352 |
| 7,886,828 | B1 | 2/2011 | Shivers, III et al. | |

* cited by examiner

FLOATING STRUCTURE AND RISER SYSTEMS FOR DRILLING AND PRODUCTION

BACKGROUND

Drilling and producing offshore oil and gas wells includes the use of offshore platforms for the exploitation of undersea petroleum and natural gas deposits. In deep water applications, floating platforms (such as spars, tension leg platforms, extended draft platforms, and semi-submersible platforms) are typically used. One type of offshore platform, a tension leg platform ("TLP"), is a vertically moored floating structure used for offshore oil and gas production. The TLP is permanently moored by groups of tethers, called a tension legs or tendons, that eliminate virtually all vertical motion of the TLP due to wind, waves, and currents. The tendons are maintained in tension at all times by ensuring net positive TLP buoyancy under all environmental conditions. The tendons stiffly restrain the TLP against vertical offset, essentially preventing heave, pitch, and roll, yet they compliantly restrain the TLP against lateral offset, allowing limited surge, sway, and yaw. Another type of platform is a spar, which typically consists of a large-diameter, single vertical cylinder extending into the water and supporting a deck. Spars are moored to the seabed like TLPs, but whereas a TLP has vertical tension tethers, a spar has more conventional mooring lines.

The offshore platforms typically support risers that extend from one or more wellheads or structures on the seabed to the platform on the sea surface. The risers connect the subsea well with the platform to protect the fluid integrity of the well and to provide a fluid conduit to and from the wellbore. During drilling operations, a drilling riser is used to maintain fluid integrity of the well. After drilling is completed, a production riser is installed.

The risers that connect the surface wellhead to the subsea wellhead can be thousands of feet long and extremely heavy. To prevent the risers from buckling under their own weight or placing too much stress on the subsea wellhead, upward tension is applied, or the riser is lifted, to relieve a portion of the weight of the riser. Since offshore platforms are subject to motion due to wind, waves, and currents, the risers must be tensioned so as to permit the platform to move relative to the risers. Accordingly, the tensioning mechanism must exert a substantially continuous tension force to the riser within a well-defined range so as to compensate for the movement of the platform.

An example method of tensioning a riser includes using buoyancy devices to independently support a riser, which allows the platform to move up and down relative to the riser. This isolates the riser from the heave motion of the platform and eliminates any increased riser tension caused by the horizontal offset of the platform in response to the marine environment. This type of riser is referred to as a freestanding riser.

Hydro-pneumatic tensioner systems are another example of a riser tensioning mechanism used to support risers. A plurality of active hydraulic cylinders with pneumatic accumulators is connected between the platform and the riser to provide and maintain the necessary riser tension. Platform responses to environmental conditions that cause changes in riser length relative to the platform are compensated by the tensioning cylinders adjusting for the movement.

Regardless of the tensioning system used, the system must be designed to accommodate with weight and movement characteristics of each riser. Since drilling risers are typically heavier than production risers, this may require the use of two different tensioning systems. On a TLP or other such platform, payload capacity and storage space are important and requiring additional tensioning systems can raise the building and operation cost of the platform. Alternatively, the tensioning systems may be brought to the platform as needed but again, this can be expensive not only in terms of transportation cost but also in costs due to any delays that may occur.

With some floating platforms, the pressure control equipment, such as the blow-out preventer, is dry because it is installed at the surface rather than subsea. However, jurisdiction regulations and other industry practices may require two barriers between the fluids in the wellbore and the sea, a so-called dual barrier requirement. With the production control equipment located at the surface, another system for accomplishing dual barrier protection is needed.

BRIEF DESCRIPTION OF THE DRAWINGS

For a detailed description of the preferred embodiments of the invention, reference will now be made to the accompanying drawings in which.

DETAILED DESCRIPTION

Figure 1:
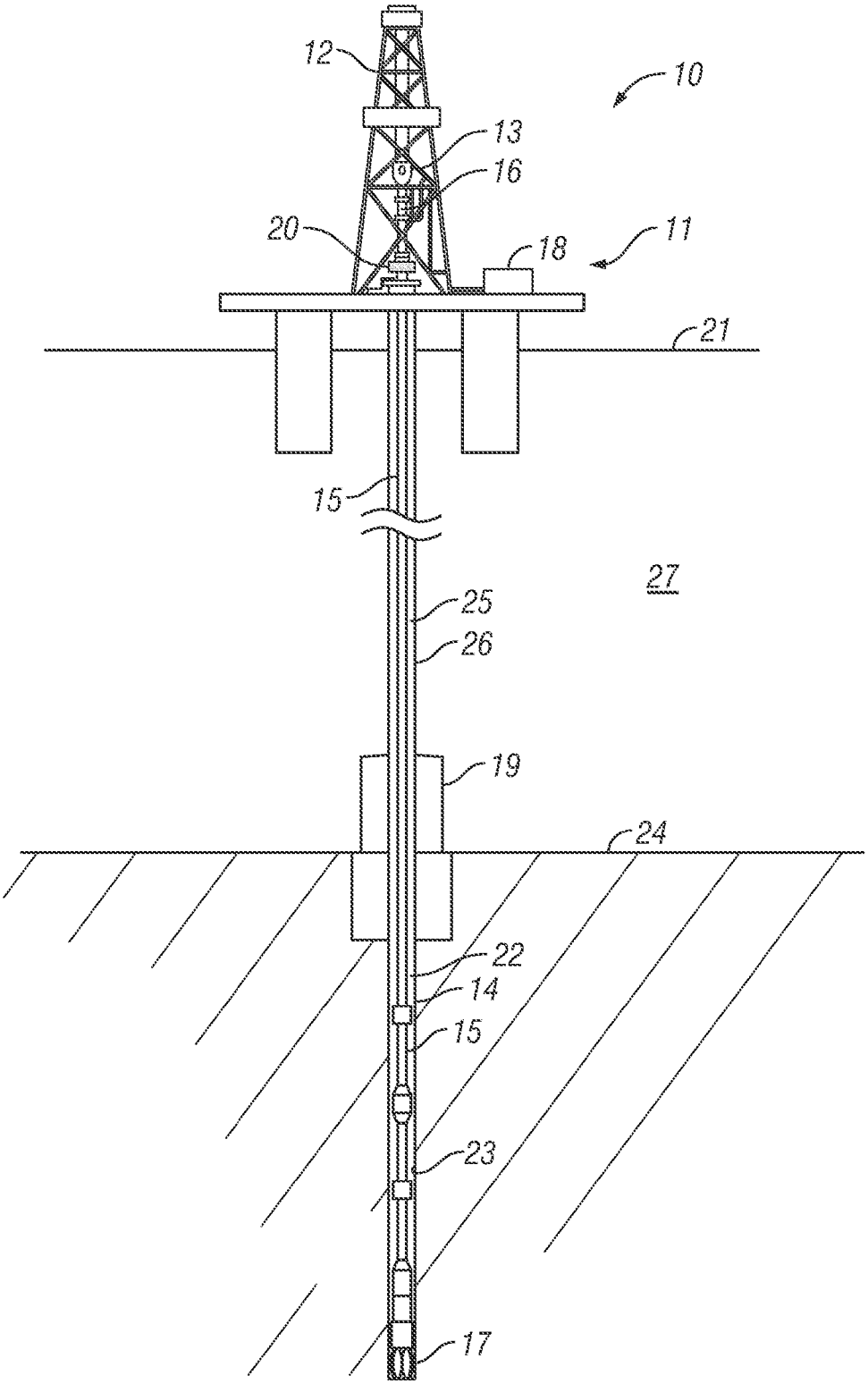
FIG. 1 shows an off-shore sea-based drilling system in accordance with various embodiments.
Figure 2:
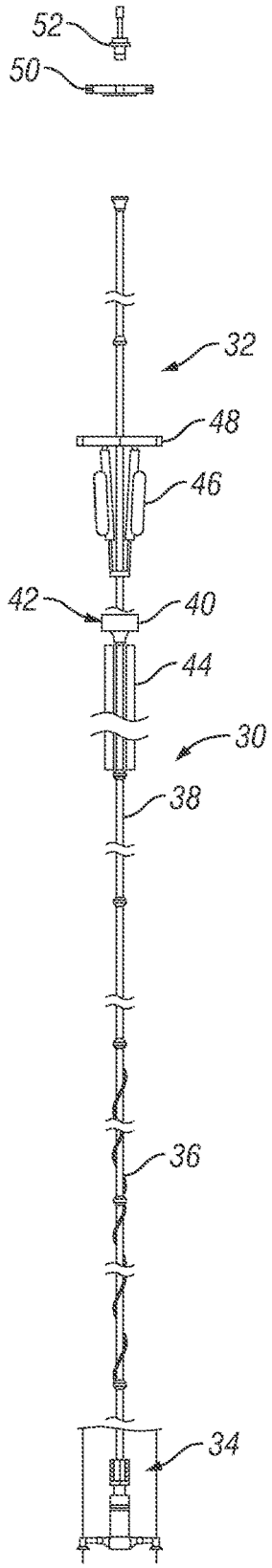
FIG. 2 shows a riser system including an outer riser with a nested internal riser.

The following discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale.

Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

Referring now to FIG. 1, a schematic view of an offshore drilling system 10 is shown. The drilling system 10 includes a floating platform 11 equipped with a drilling module 12 that supports a hoist 13. Drilling of oil and gas wells is carried out by a string of drill pipes connected together by tool joints 14 so as to form a drill string 15 extending subsea from platform 11. The hoist 13 suspends a kelly 16 used to lower the drill string 15. Connected to the lower end of the drill string 15 is a drill bit 17. The bit 17 is rotated by rotating the drill string 15 and/or a downhole motor (e.g., downhole mud motor). Drilling fluid, also referred to as drilling mud, is pumped by mud recirculation equipment 18 (e.g., mud pumps, shakers, etc.) disposed on the platform 11. The drilling mud is pumped at a relatively high pressure and volume through the drilling kelly 16 and down the drill string 15 to the drill bit 17. The drilling mud exits the drill bit 17 through nozzles or jets in face of the drill bit 17. The mud then returns to the platform 11 at the sea surface 21 via an annulus 22 between the drill string 15 and the borehole 23, through subsea wellhead 19 at the sea floor 24, and up an annulus 25 between the drill string 15 and a drilling riser system 26 extending through the sea 27 from the subsea wellhead 19 to the platform 11. At the sea surface 21, the drilling mud is cleaned and then recirculated by the recirculation equipment 18. The drilling mud is used to cool the drill bit 17, to carry cuttings from the base of the borehole to the platform 11, and to balance the hydrostatic pressure in the rock formations. In the embodiment shown, pressure control equipment such as a blow-out preventer ("BOP") 20 is located on the floating platform 11 and connected to the riser system 26, making the system a dry BOP system because there is no subsea BOP located at the subsea wellhead 19.

As shown in FIGS. 2-5, in a first embodiment the pressure control equipment is located at the platform 11 and the dual barrier requirement may be met by the riser system 26 including a freestanding external drilling riser 30 with a nested internal riser 32. As shown, the external riser 30 surrounds at least a portion of the internal riser 32. The riser system 26 is shown broken up to be able to include detail on specific sections but it should be appreciated that the riser system 26 maintains fluid integrity from the subsea wellhead 19 to the platform 11.

A nested riser system requires both the external riser 30 and the internal riser 32 to be held in tension to prevent buckling. Complications may occur in high temperature, deep water environments because different thermal expansion is realized by the external riser 30 and the internal riser 32 due to different temperature exposures—higher temperature drilling fluid versus seawater. To accommodate different tensioning requirements, independent tension devices are provided to tension the external riser 30 and the internal riser 32 at least somewhat or completely independently.

In this embodiment, the external riser 30 is attached at its lower end to the subsea wellhead 19 (shown in FIG. 1) using an appropriate connection. For example, the external riser 30 may include a wellhead connector 34 with an integral stress joint as shown. As an example, the wellhead connector 34 may be an external tie back connector. Alternatively, the stress joint may be separate from the wellhead connector 34. The external riser 30 may or may not include other specific riser joints, such as riser joints 36 with strakes or fairings and splash zone joints 38. The upper end of the external riser 30 terminates in a diverter 40 that directs fluid to a solids management system of the drilling module 12 as indicated by the arrow 42 for recirculation into the drilling system.

Also included on the external riser 30 is a tension system 44 in the form of at least one buoyancy system that provides tension on the external riser 30 independent of the platform 11. The external riser tension system 44 may be any suitable configuration for providing buoyancy such as air cans, balloons, or foam sections, or any combination of these configurations. The external riser tension system 44 may also be located at another location along the external riser 30 than shown in FIG. 2. The external riser tension system 44 may also be located along or at more than one location along the external riser 30. The external riser tension system 44 provides the external riser 30 with its own tension and thus enables the external riser 30 to be a freestanding riser.

In this embodiment, the internal riser 32 is nested within the external riser 30 and is attached at its lower end to the subsea wellhead 19 (FIG. 1) or to a casing or casing hanger landed in the subsea wellhead 19 using an appropriate connection. For example, the internal riser 32 may stab into a connection in the wellhead 19 with or without rotating to lock in place. The internal riser 32 may also connect inside the external tieback connector 34. The internal riser 32 extends to the platform 11 within the external riser 30, forming an annulus between the external riser 30 and the internal riser 32. The internal riser 32 extends past the upper end of the external riser 30 to the platform 11.

Figure 3:
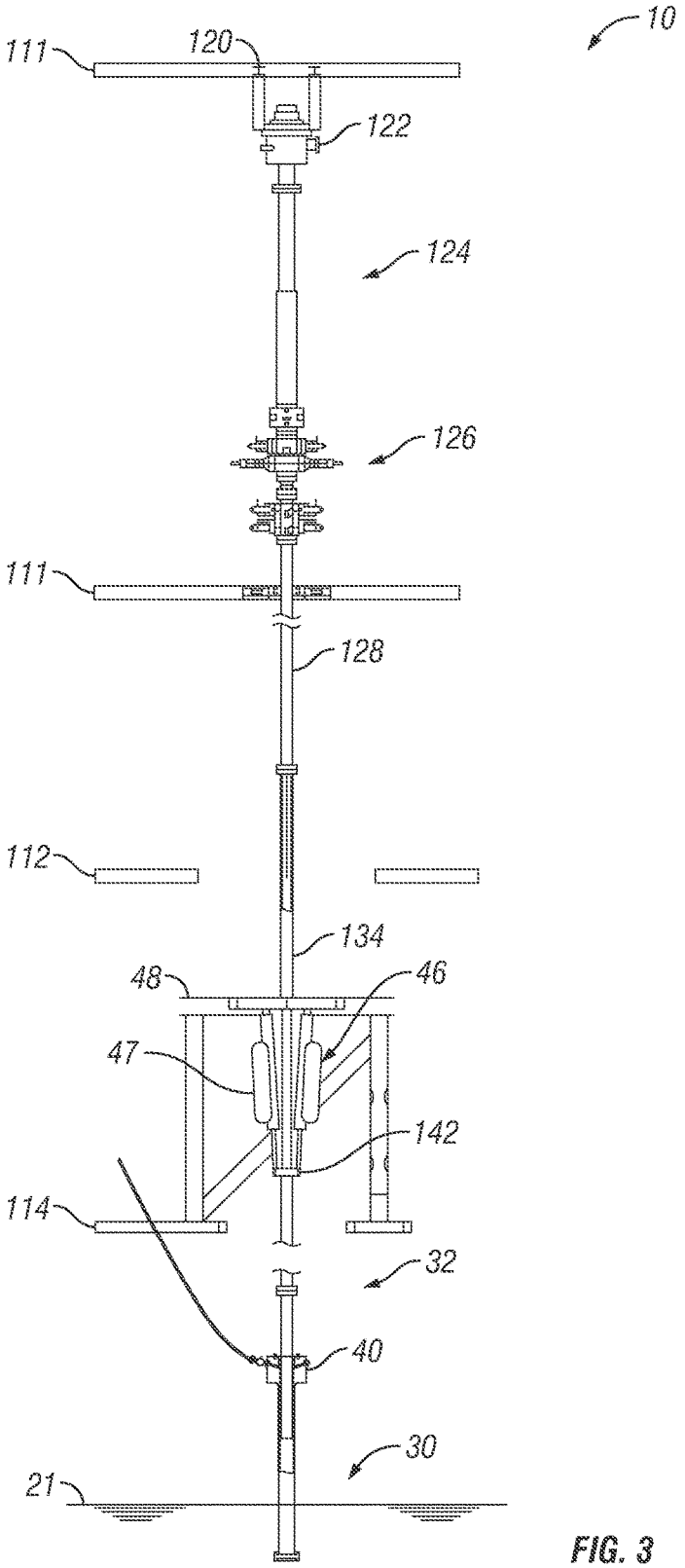
FIG. 3 shows a partial close up view of the tensioning system and riser system of FIG. 2 with a dual-barrier riser configuration in accordance with various embodiments.
Figure 4:
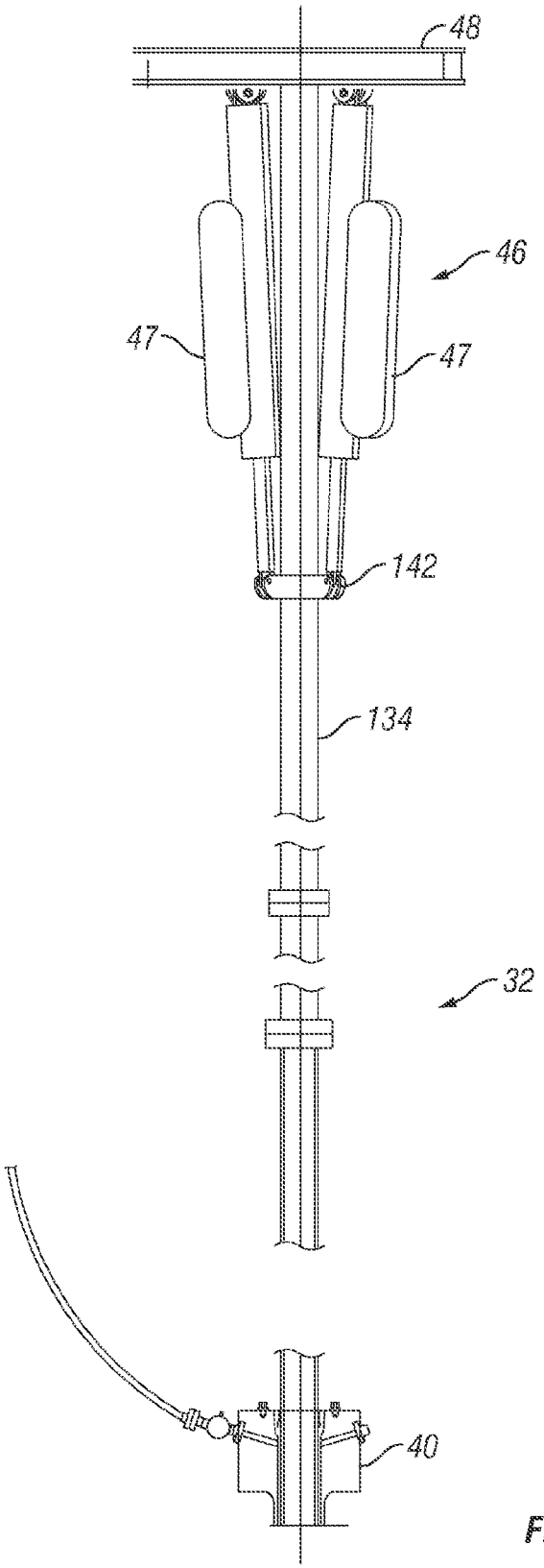
FIG. 4 shows a partial close up view of the tensioning system of FIGS. 2 and 3 with a dual-barrier riser configuration in accordance with various embodiments.

Referring now to FIGS. 3 and 4, the drilling system 10 the floating platform 11 includes drill floors 111, a mezzanine deck 112, the tensioner deck 48, and a production deck 114 located above the sea level 21. The drilling system 10 is equipped with a rotary table 120, a diverter 122, a telescopic joint 124, a surface BOP unit 126, and a BOP spool 128. The rotary table 120 revolves to turn the drillstring for drilling the well. Alternatively, the platform 11 may include a topdrive or other rotary means. The diverter 122 seals against the drillstring and diverts return drilling mud to the recirculation equipment. The telescopic joint 124 allows relative movement between the BOP unit 126 and the diverter 122 by allowing an inner pipe to move within an outer pipe. The BOP spool 128 connects the BOP unit 126 with the internal riser 32. As shown, the internal riser 32 includes a tension joint 134.

The subsea well is drilled using a string of drill pipes connected together by tool joints to form a drill string extending subsea from the platform. Connected to the lower end of the drill string is a drill bit. The bit is rotated by rotating the drill string and/or a downhole motor (e.g., downhole mud motor). Drilling fluid, also referred to as drilling mud, is pumped by mud recirculation equipment (e.g., mud pumps, shakers, etc.) disposed on the platform. The drilling mud is pumped at a relatively high pressure and volume down the drill string to the drill bit. The drilling mud exits the drill bit through nozzles or jets in face of the drill bit. The mud then returns to the platform at the sea surface via an annulus between the drill string and the borehole, through the subsea wellhead at the sea floor, and up an annulus between the drill string and the riser system 32. At the platform, the drilling mud is cleaned and then recirculated by the recirculation equipment. The drilling mud is used to cool the drill bit, to carry cuttings from the base of the borehole to the platform, and to balance the hydrostatic pressure in the rock formations. Pressure control equipment such as the BOP unit 26 is located on the floating platform and connected to the riser system 32.

As shown in FIGS. 3 and 4, an internal riser tension system 46 is attached to the internal riser 32 at the tension joint 134 using a tensioner ring 142. The internal riser tension system 46 is supported on the tensioner deck 48 and dynamically tensions the internal riser 32. This allows the tension system 46 to adjust for the movement of the platform 11 while maintaining the internal riser 32 under proper tension. The internal riser tension system 46 may be any appropriate system, such as a hydro-pneumatic tensioner system with tensioning cylinders 47 as shown.

Other appropriate equipment for installation or removal of the external riser 30 and the internal riser 32, such as a riser running tool 50 and spider 52 may also be located on the platform 11.

The riser system 26 is installed by first running the internal riser 32 and locking its lower end in place. Then, the external riser 30 is installed surrounding the internal riser 32. In use, the internal riser 32 provides a return path to the platform 11 for the drilling fluid. Typically, the external riser 30 is filled with seawater unless drilling or other fluids enter the external riser 30.

In this embodiment, when installed, the internal riser 32 is free to move within the external riser 30 and is tensioned completely independently of the external riser 30. Alternatively, the internal riser 32 may be placed in tension and locked to the external riser 30 such that the external riser tension device 44 supports some of the needed tension for the internal riser 32. Also alternatively, the external riser 30 may be tensioned and then locked to the internal riser 32 such that the internal riser tension device 46 supports at least some of the needed tension for the external riser 30.

Once drilling operations for the well are complete, production equipment may be installed on the well for producing hydrocarbons. The well is temporarily shut in using plugs in the subsea wellhead or any other suitable barrier. The internal riser 32 is then disconnected from the subsea wellhead 19 and pulled up from the sea floor. Next the external riser 30 is disconnected from the subsea wellhead 19 and then pulled up to the platform.

Figure 5:
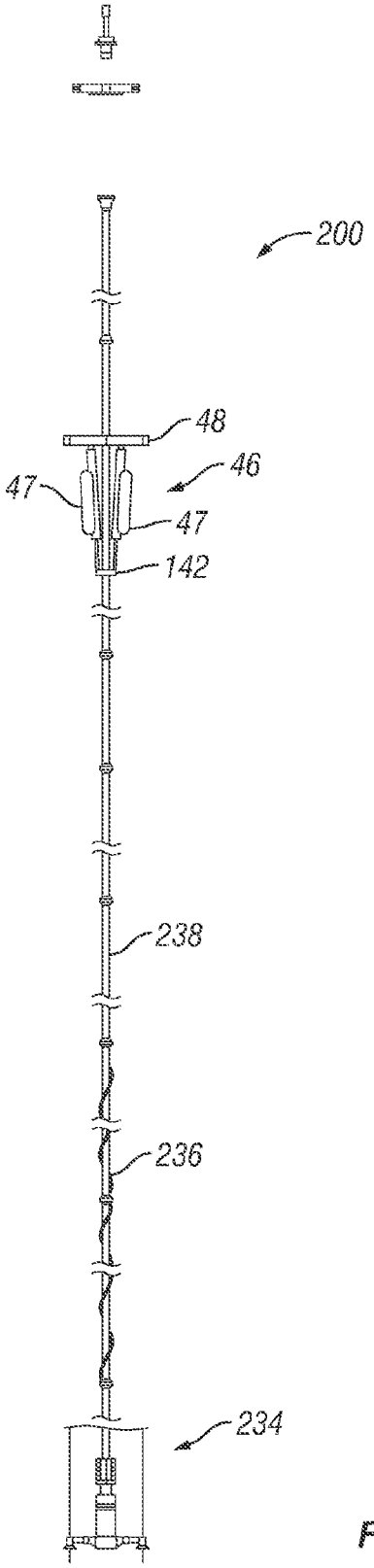
FIG. 5 shows a tensioning system and riser system in accordance with various embodiments.

As shown in FIG. 5, once the drilling riser system 26 is uninstalled, a production riser system 200 is installed. The production riser system 200, similar to the drilling riser system 26, is attached at its lower end to the subsea wellhead 19 (shown in FIG. 1) using an appropriate connection. For example, the production riser system 200 may include a wellhead connector 234 with an integral stress joint as shown. As an example, the wellhead connector 234 may be an external tie back connector. Alternatively, the stress joint may be separate from the wellhead connector 234. The production riser system 200 may or may not include other specific riser joints, such as riser joints 236 with strakes or fairings and splash zone joints 238. The upper end of the production riser system 200 terminates in production equipment at the surface, such as a surface wellhead and production tree (not shown).

The tension system 46 shown in FIG. 5 is the same tension system 46 used to compensate for movement of the internal drilling riser 32 discussed above. Because the drilling riser system 26 used a dual-barrier system with an external riser 30, the internal riser 32 was able to be designed to match or even require less tension than the design for the production riser system 200. Therefore, the tension system 46 is used to compensate for movement and keep the drilling riser system 26 and the production riser system 200 under the appropriate amount of tension to prevent buckling.

The benefit of being able to use a common tension system 46 for both drilling and production risers saves the need to store multiple tension systems of different strengths on the platform 11, one for drilling and one for production. Also, different tensioning systems do not need to be transported to the platform 11, saving time and costs. Additional time can be saved because the tension system for drilling does not need to be removed and another tension system installed for production. Instead, the tension system may be left in place for installation of the production riser.

Figure 6:
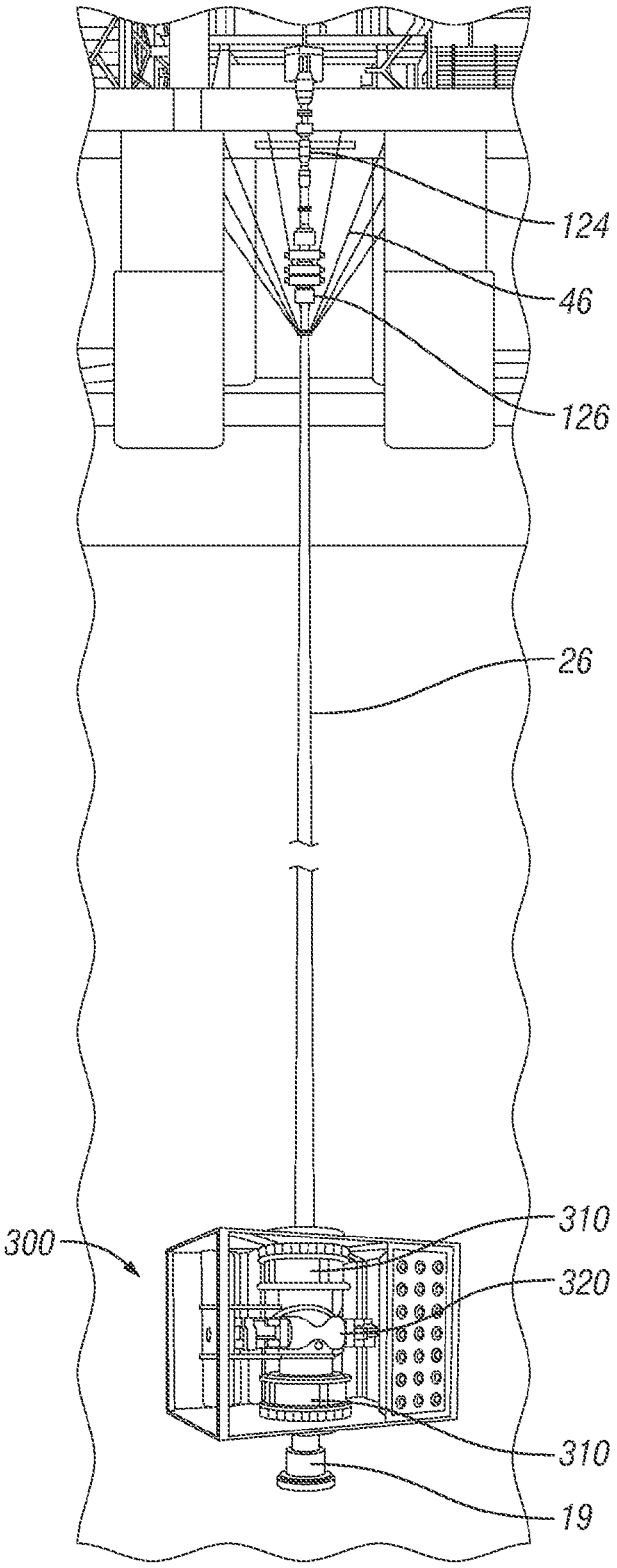
FIG. 6 shows optional subsea safety equipment for use in accordance with various embodiments.

FIG. 6 shows an optional subsea pressure control system 300, which may be used for drilling operations. The subsea pressure control system 300, while not the size of a full-size traditional subsea BOP stack, may be used to shear, seal, and disconnect from the seabed while the surface BOP unit 126 handles the main pressure control functions during drilling operations. As an example, the subsea pressure control system may be the ENVIRONMENTAL SAFE GUARD™ (ESG™) system from Cameron International Corporation. The subsea pressure control system 300 includes appropriate connectors 310 for connecting to the drilling riser system 26 and the subsea wellhead 19. The subsea pressure control system 300 also includes a ram-type BOP 320 with shearing blind rams and a control system. The control system may be, for example, an acoustic, electric, ROV-actuated, or hydraulic control system, or any other suitable control system for operating the subsea pressure control system 300.

In the event of a situation where the platform 11 is moved from the well site, the control system is used to signal the subsea pressure control system BOP to shear the pipe in the riser system 26. Once the shearing blind rams shear and seal off the bore, the control system is used to signal the upper connector to the riser system 26 to disconnect, allowing the platform 11 to be moved off location with the drilling riser attached. Alternatively, if there is no pipe inside the subsea pressure control system 300 and the well has been contained using other appropriate barriers, the subsea pressure control system 300 may disconnect from the subsea wellhead 19 by disconnecting the lower connector while remaining attached to the riser system 26. The subsea pressure control system 300 may then either travel with the riser system 26 off site or simply be moved to the next well ready for drilling.

Figure 7:
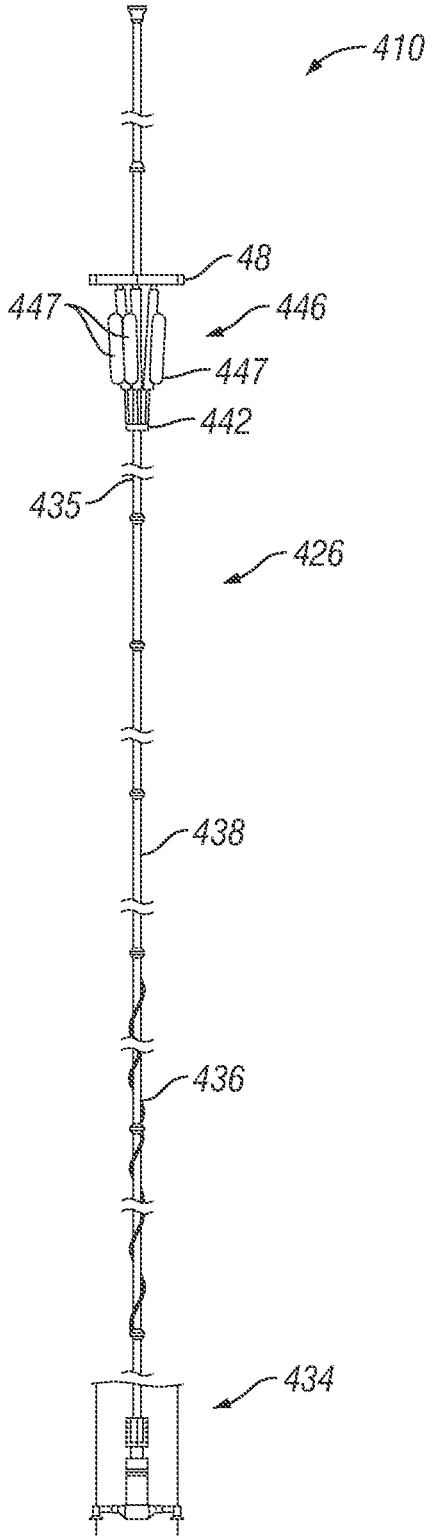
FIG. 7 shows an off-shore drilling system with a riser system in accordance with another embodiment.

Another embodiment of an offshore drilling system 410 is shown in FIG. 7. Unlike the drilling riser system discussed above, the offshore drilling system 410 shown uses a single barrier drilling riser system 426. The single barrier drilling riser system 426 is attached at its lower end to the subsea wellhead 19 (shown in FIG. 1) using an appropriate connection. For example, the drilling riser system 426 may include a wellhead connector 434 with an integral stress joint as shown. As an example, the wellhead connector 434 may be an external tie back connector. Alternatively, the stress joint may be separate from the wellhead connector 434. The riser system 426 may or may not include other specific riser joints, such as riser joints 436 with strakes or fairings and splash zone joints 438. The upper end of the riser system 426 terminates in pressure control equipment at the surface, such as the surface BOP 20 of FIG. 1.

A riser tension system 446 is attached to the drilling riser system 432 at a tension joint 435 by using a tensioner ring 442 on the riser system 426. The riser tension system 446 is supported on the tensioner deck 48 and dynamically tensions the riser system 432. This allows the tension system 446 to adjust for the movement of the platform 11 while maintaining the drilling riser system 432 under proper tension.

The riser tension system 446 may be any appropriate system, such as a hydro-pneumatic tensioner system with tensioning cylinders 447 as shown. Unlike the tension system 46 discussed above however, the tension system 446 shown in FIG. 7 allows for the attachment and removal of supplemental tensioning cylinders 447. As shown, the riser tension system 446 includes enough tensioning cylinders 447 to support the movement of the drilling riser system 432. For example, the tension system 446 may include 4-8 tensioning cylinders 447. However, when the drilling operations are complete and the drilling riser is replaced with the production riser, tensioning cylinders 447 that are not needed may be removed from the riser tension system 446. The supplemental tensioning cylinders 447 may then be used to support the drilling riser system 426 on the next well being drilled using the platform 11.

In this manner, similar to above, the same tension system 446 is used to compensate for movement of the drilling riser 432 as the production riser. Instead of using different tension systems for drilling and production, the drilling system 410 uses a common riser tension system 446 and adjusts for the additional tensioning requirements of the drilling riser system 426 by temporarily adding supplemental tensioning cylinders 447. Therefore, the tension system 46 is used to compensate for movement and keep the drilling riser system 426 and the production riser system under the appropriate amount of tension to prevent buckling.

This benefit of being able to use a common tension system 446 for both drilling and production risers saves the need to multiple strength tension systems on the platform 11, one for drilling and one for production. Also, different tensioning systems do not need to be transported to the platform 11, increasing time and costs. Additional time can be saved because the tension system for drilling does not need to be completely removed and another tension system installed for production. Instead, the supplemental hydraulic cylinders 447 need only be added or removed.

Although the present invention has been described with respect to specific details, it is not intended that such details should be regarded as limitations on the scope of the invention, except to the extent that they are included in the accompanying claims.

What is claimed is:

1. An offshore well system for a subsea well with an offshore platform, comprising:

an internal riser tension device configured to apply tension to an internal riser that extends between the subsea well and the offshore platform to facilitate drilling and production operations; and an external riser tension device configured to apply tension to an external riser that circumferentially surrounds at least a portion of the internal riser to facilitate drilling operations, wherein the external riser tension device is configured to support the external riser independent of the platform to enable the external riser to be a freestanding riser.

2. The offshore well system of claim 1, wherein the internal riser tension device includes removable active tensioning cylinders.

3. The offshore well system of claim 1, wherein the external riser tension device includes a buoyancy device.

4. The offshore well system of claim 3, wherein the buoyancy device is at least one of an air can, balloon, and foam.

5. The offshore well system of claim 1, wherein the internal riser is free to move within the external riser.

6. The offshore well system of claim 1, wherein internal riser tension device is configured to place the internal riser in tension dynamically.

7. The offshore well system of claim 1, wherein the internal riser extends from an upper end of the external riser when installed.

8. The offshore well system of claim 1, wherein only a portion of the internal riser is nested within the external riser.

9. The offshore well system of claim 1, wherein the offshore well system comprises a blowout preventer supported on the offshore platform and is devoid of an additional blowout preventer supported at a subsea location proximate to the subsea well.

10. A method for drilling and producing hydrocarbons from an offshore platform, comprising:

tensioning an inner riser configured for drilling and production operations with an inner riser tensioning system;

tensioning an outer riser configured for drilling operations with an outer riser tensioning system that is configured to support the outer riser independent of the offshore platform to enable the outer riser to be a freestanding riser;

drilling one or more subsea wells with the inner riser and outer riser under tension; and producing from the one or more subsea wells with the inner riser.

11. The method of claim 10, wherein the outer riser tensioning system comprises coupling a buoyancy device to the outer riser.

12. The method of claim 11, wherein the buoyancy device is at least one of an air can, balloon, and foam.

13. An offshore well system for a subsea well with an offshore platform, including:

a drilling riser system connectable with the well for drilling operations, wherein the drilling riser system comprises a first weight;

a production riser system connectable with the well for production operations separately from the drilling riser system, wherein the production riser system comprises a second weight different from the first weight;

a riser tension system configured to tension the drilling riser system and the production riser system successively by removing one of the drilling riser system or production riser system from the riser tension system and connecting the other system to the riser tension system;

wherein the drilling riser system includes an internal riser movably nested within and extendable above an external riser;

the production riser system includes a single production riser; and the riser tension system includes a dynamic riser tensioner to tension the internal riser and the production riser when each are connected to the well.

14. The offshore well system of claim 13, wherein:

the drilling riser system includes a drilling riser; and the dynamic riser tensioner is adjustable.

15. The offshore well system of claim 14, wherein the riser tensioner includes removable active tensioning cylinders.

16. The offshore well system of claim 15, wherein the riser tensioner is convertible from tensioning the drilling riser to tensioning the production riser by changing the number of tensioning cylinders.

17. The offshore well system of claim 15, wherein the riser tensioner is convertible from tensioning the production riser to tensioning the drilling riser by changing the number of tensioning cylinders.

18. The offshore well system of claim 13, further including an external riser tension device to apply tension to the external riser independently from the riser tension system.

19. The offshore well system of claim 18, wherein the external riser tension device includes a buoyancy system.

20. The offshore well system of claim 13, wherein the riser tension system is capable of tensioning both the drilling riser system and the production riser system with the riser tension system in the same configuration.

21. The offshore well system of claim 13, wherein the drilling riser system comprises a drilling riser that extends from a respective first end configured to couple to a subsea blowout preventer assembly or a subsea wellhead and a respective second end configured to couple to a blowout preventer assembly located on the offshore platform, and the production riser system comprises a production riser that extends from a respective first end configured to couple to the subsea wellhead and a respective second end configured to couple to a production equipment located on the offshore platform.

* * * * *